US008182725B2

(12) United States Patent
Green et al.

(10) Patent No.: US 8,182,725 B2
(45) Date of Patent: May 22, 2012

(54) METHODS FOR MAKING POLYLACTIC ACID STEREOCOMPLEX FIBERS

(75) Inventors: Robert A. Green, Cary, NC (US); Chad Henry Kamann, Carver, MN (US); Jeffrey John Kolstad, Wayzata, MN (US)

(73) Assignee: NatureWorks LLC, Minnetonka, MN (US)

( * ) Notice: Subject to any disclaimer, the term of this patent is extended or adjusted under 35 U.S.C. 154(b) by 109 days.

(21) Appl. No.: 12/679,365

(22) PCT Filed: Sep. 26, 2008

(86) PCT No.: PCT/US2008/077801

§ 371 (c)(1),
(2), (4) Date: Mar. 22, 2010

(87) PCT Pub. No.: WO2009/045877

PCT Pub. Date: Apr. 9, 2009

(65) Prior Publication Data

US 2010/0308494 A1 Dec. 9, 2010

Related U.S. Application Data

(60) Provisional application No. 60/995,868, filed on Sep. 28, 2007.

(51) Int. Cl.

| | |
|---|---|
| ***D01D 5/088*** | (2006.01) |
| ***D01D 5/26*** | (2006.01) |
| ***D01D 5/16*** | (2006.01) |
| ***D02G 3/02*** | (2006.01) |
| ***D02J 1/22*** | (2006.01) |

(52) U.S. Cl. ..... 264/103; 264/143; 264/210.8; 264/211; 264/211.14; 264/211.15; 264/211.17; 264/211.2; 264/234

(58) Field of Classification Search ..... 264/103, 264/143, 210.8, 211, 211.14, 211.15, 211.17, 264/211.2, 234

See application file for complete search history.

(56) References Cited

U.S. PATENT DOCUMENTS

| | | | | |
|---|---|---|---|---|
| 5,010,145 | A | 4/1991 | Ikada | |
| 5,254,299 | A | 10/1993 | Krupp | |
| 5,270,400 | A | 12/1993 | Spinu | |
| 5,290,626 | A | 3/1994 | Nishio | |
| 6,761,970 | B2 | 7/2004 | Ochi | |
| 2003/0054718 | A1 * | 3/2003 | Ochi et al. | 442/182 |
| 2003/0082360 | A1 * | 5/2003 | O'Donnell et al. | 428/292.1 |
| 2005/0154148 | A1 * | 7/2005 | Nakamichi et al. | 525/450 |
| 2007/0172651 | A1 | 7/2007 | Miyoshi | |
| 2008/0287024 | A1 | 11/2008 | Chakravarty | |
| 2009/0110927 | A1 | 4/2009 | Mochiduki | |
| 2010/0234558 | A1 * | 9/2010 | Yoshida et al. | 264/210.8 X |

FOREIGN PATENT DOCUMENTS

| | | | |
|---|---|---|---|
| EP | 288041 | A | 10/1988 |
| EP | 1731633 | A | 12/2006 |
| JP | 2002-030523 | A | 1/2002 |
| JP | 2002-356543 | A | 12/2002 |
| JP | 2006-028336 | A | 2/2006 |
| JP | 2006-299244 | A | 11/2006 |
| JP | 2006-307071 | A | 11/2006 |
| JP | 2007070750 | A * | 3/2007 |
| WO | 2006-104092 | A | 10/2006 |
| WO | 2007-070064 | A | 6/2007 |
| WO | 2009-042837 | A | 4/2009 |
| WO | 2009-045881 | A | 4/2009 |
| WO | 2009-045887 | A | 4/2009 |

OTHER PUBLICATIONS

Translation of JP 2007070750 A (published on Mar. 22, 2007).*

* cited by examiner

*Primary Examiner* — Leo B Tentoni
(74) *Attorney, Agent, or Firm* — Gary C Cohn PLLC

(57) ABSTRACT

PLA stereocomplex fibers are made by separately melting a high-D PLA starting resin and a high-L starting resin, mixing the melts and spinning the molten mixture. Subsequent heat treatment introduces high-melting "stereocomplex" crystallinity into the fibers. The process can form fibers having a high content of "stereocomplex" crystallites that have a high melting temperature. As a result, the fibers have excellent thermal resistance. The process is also easily adaptable to commercial melt spinning operations.

25 Claims, No Drawings

METHODS FOR MAKING POLYLACTIC ACID STEREOCOMPLEX FIBERS

This application claims priority from U.S. Provisional Patent Application No. 60/995,868, filed 28 Sep. 2007.

This invention relates to a melt spinning process for making fibers from polylactide resins.

Polylactide resins (also known as polylactic acid, or PLA) are now available commercially. These resins can be produced from annually renewable resources such as corn, rice or other sugar- or starch-producing plants. In addition, PLA resins are compostable. For these reasons, there is significant interest in substituting PLA into applications in which oil-based thermoplastic materials have conventionally been used. To this end, PLA has been implemented into various applications such as fibers for woven and nonwoven applications.

A problem with PLA resins is that they have heat resistance that is inadequate for some applications. PLA resins generally exhibit a crystalline melting temperature ($T_m$) in the range from 140 to 170° C. Due to the relatively low crystalline melt point, the PLA fiber products are often susceptible to heat damage (shrinkage or melting) when ironed or heated in a dryer.

Somewhat better high temperature performance can be obtained by introducing higher-melting "stereocomplex" crystallinity into the polymer. Because lactic acid contains a chiral carbon atom, it exists in both D- (R-) and L- (S-) forms. This chirality is preserved when the lactic acid is formed into a PLA resin, and so each repeating lactic acid unit in the polymer has either the D- or the L-configuration. Mixtures of a PLA resin that predominantly contains D-lactic acid units with another PLA resin that predominantly contains L-lactic acid units can form a crystalline structure that is known as a "stereocomplex". The stereocomplex crystallites exhibit a crystalline melting temperature as much as 60° C. higher than that of the high D- or high L-resin by itself. In principle, the heat resistance of a PLA fiber can be increased quite significantly if these stereocomplex crystallites are present in sufficient quantities.

However, PLA stereocomplexes are so difficult to melt process into fibers that no commercial PLA stereocomplex fiber product has been developed. The processing problem is due in large part to the high crystalline melting temperature of the stereocomplex. PLA resins degrade rapidly at the temperatures needed to melt the stereocomplex crystallites. This makes it difficult to melt-process the materials, as polymer molecular weight is lost when the stereocomplex is processed. The loss of molecular weight can have a significant adverse affect on the properties and processing of the fibers. In addition, stereocomplex crystallites often do not form in the finished fiber, or else have a melting temperature that is lower than expected. Because of this, the fibers sometimes do not have the expected heat resistance.

Research scale methods have attempted to circumvent this problem by spinning stereocomplex fibers from solution. Solution spinning allows lower temperatures to be used, so less polymer degradation is seen. But this is an unsatisfactory approach from the standpoint of commercial production, as the use of solvents increases costs, adds much complexity to the process, and raises concerns about worker exposure to volatile organic materials. Melt processing methods are needed to make stereocomplex fibers economically on a large scale.

It would be desirable to provide an efficient and economical process for producing PLA fibers that have good heat resistance.

This invention is a process for making a fiber of a polylactic acid, comprising a) forming separate melts of a high-D PLA starting resin and a high-L PLA starting resin;

b) mixing the melts and, without cooling the resulting mixed melt below the crystallization temperature of either the high-D PLA starting resin or the high-L starting resin, melt spinning the mixture through one or more orifices to form one or fibers, then c) cooling the fibers below the crystalline melting temperature of the high-D PLA starting resin and the crystalline melting temperature of the high-L starting resin, and d) heat treating the fibers at a temperature between the glass transition temperature of the starting PLA resins and the crystallization melting temperature of the starting PLA resins for a period of time such that the fibers form at least 20 Joules/g of crystallites having a crystalline melting temperature of at least 200° C.

The process can form fibers having a high content of "stereocomplex" crystallites that have a high melting temperature. The process also can be operated to minimize polymer degradation during the melt spinning operation. As a result, the fibers have excellent heat resistance and physical properties. The process is capable of being operated at the high line speeds that are commonly used in commercial fiber production. The process is also easily adaptable to commercial melt spinning operations. The heat-treatment step d) can be incorporated into one or more downstream (i.e., post-spinning) processing steps as are often used to produce commercial fiber products such as filament yarns, staple fibers and melt-blown or spun bond products.

The approach of forming separate melts of a high-D PLA starting resin and a high-L PLA starting resin and mixing the melts without cooling, can be used in other polymer conversion/fabrication processes such as film/sheet extrusion, injection molding, or extrusion coating. However, greater commercial benefits are anticipated for fiber production.

Fiber is formed in this invention from at least two starting PLA resins, one of which is a high-D resin and one of which is a high-L resin. For the purposes of this invention, the terms "polylactide", "polylactic acid" and "PLA" are used interchangeably to denote polymers having repeating units of the structure —OC(O)CH($CH_3$)—. The PLA resin preferably contains at least 90%, such as at least 95% or at least 98%, by weight of those repeating units. These polymers are readily produced by polymerizing lactic acid or, more preferably, by polymerizing lactide.

Lactic acid exists in two enantiomeric forms, the so-called "L-" and "D-" forms. The —OC(O)CH($CH_3$)— units produced by polymerizing lactic acid or lactide retain the chirality of the lactic acid. A PLA resin will therefore contain, in polymerized form, one or both of the "L" and the "D" enantiomers. In this invention, a "high-D" PLA starting resin is one in which the D-enantiomer constitutes at least 90% of the polymerized lactic acid repeating units in the polymer. The high-D starting resin preferably contains at least 95% of the polymerized D-enantiomer. The high-D starting resin may contain up to essentially 100% of the polymerized D-enantiomer. The high-D starting resin more preferably contains at least 95.5% of the polymerized D-enantiomer, and most preferably contains from 95.5 to 99% of the polymerized D-enantiomer.

Similarly, a high-L starting resin is one in which the L-enantiomer constitutes at least 90% of the polymerized lactic acid repeating units in the polymer. It preferably contains at least 95% of the polymerized L-enantiomer. The high-L starting resin may contain essentially 100% of the polymerized L-enantiomer. The high-L starting resin more preferably contains at least 95.5% of the polymerized L-enantiomer, and most preferably contains from 95.5 to 99% of the polymerized L-enantiomer.

The high-D and high-L PLA starting resins each have molecular weights that are high enough for melt processing applications. A number average molecular weight in the range of 20,000 to 150,000, as measured by gel permeation chromatography against a polystyrene standard, is generally suitable, although somewhat higher and lower values can be used in some circumstances. The molecular weight of the high-D and high-L starting resins may be similar to each other (such as a number average molecular weight difference of 20,000 or less). It is also possible that the molecular weights of the high-D and high-L starting resins differ by a larger amount.

Either or both of the starting PLA resins may further contain repeating units derived from other monomers that are copolymerizable with lactide or lactic acid, such as glycolic acid, hydroxybutyric acid, other hydroxyacids or their respective cyclic dianhydride dimers; alkylene oxides (including ethylene oxide, propylene oxide, butylene oxide, tetramethylene oxide, and the like); cyclic lactones; or cyclic carbonates. Repeating units derived from these other monomers can be present in block and/or random arrangements. Such other repeating units preferably constitute from 0 to 5% by weight of the PLA resin, if present at all. The starting PLA resins are most preferably essentially devoid of such other repeating units.

The starting PLA resins may also contain residues of an initiator compound, which is often used during the polymerization process to provide control over molecular weight. Suitable such initiators include, for example, water, alcohols, glycol ethers, polyhydroxy compounds of various types (such as ethylene glycol, propylene glycol, polyethylene glycol, polypropylene glycol, glycerine, trimethylolpropane, pentaerythritol, hydroxyl-terminated butadiene polymers and the like). A compound having at least one hydroxyl group and at least one carboxyl group, such as lactic acid or a lactic acid oligomer, is also suitable. The initiator residue preferably constitutes no more than 5%, especially no more than 2%, of the weight of the starting PLA resin, except when the initiator a lactic acid oligomer, in which case the initiator can constitute a greater proportion of the PLA resin chain.

A particularly suitable process for preparing the starting PLA resins by polymerizing lactide is described in U.S. Pat. Nos. 5,247,059, 5,258,488 and 5,274,073. This preferred polymerization process typically includes a devolatilization step during which the free lactide content of the polymer is reduced, preferably to less than 1% by weight, more preferably less than 0.5% by weight and especially less than 0.2% by weight.

The polymerization catalyst is preferably deactivated or removed from the starting PLA resins. Residues of a polymerization catalyst can catalyze transesterification reactions between the starting PLA resins when they are mixed together in the melt. This transesterification can in some cases render the resins incapable of forming high-melting "stereocomplex" crystallites. In other cases, the transesterification reactions can result in a reduction of the melting temperature of the "stereocomplex" crystallites. The transesterification reactions also tend to reduce molecular weights. For these reasons, it is also preferred not to add other materials that can cause the starting PLA resins to transesterify with each other significantly.

In the process of this invention, the high-D and high-L PLA resins are separately melted by heating each of them to a temperature above their respective crystalline melting temperatures. High-D and high-L resins that have molecular weights high enough for melt-processing operations typically have crystalline melting temperatures of approximately 140 to 170° C. Therefore, a suitable melting temperature is generally at least about 160 to 170° C. The melted starting resins can be brought to a higher temperature, up to the temperature at which the fibers are to be spun. This higher temperature is preferably at least 210° C. and up to 240° C. The advantage of using temperatures of 200° C. or greater is that the melt viscosity of the mixture is lower at the higher temperatures and process pressures can be reduced. However, higher temperatures also favor increased transesterification between the starting polymers and increased molecular weight degradation.

The heated starting resins are then mixed and the mixture is melt spun through one or more orifices to form a fiber or fibers. The spinning operation is performed without cooling the mixture of high-D and high-L resins to below the crystallization temperature of either of the starting resins; i.e., the temperature of the molten blend of high-D and high-L PLA resins is maintained at or above the crystalline melting temperature of each of the starting PLA resins until the melt spinning operation is performed. The crystalline melting temperatures of the starting PLA resins typically will be the same or very close to each other, usually in the range of 140° C. to 170° C.

The weight ratio of the high-D and high-L resins in the mixture is suitably between 25:75 and 75:25. A more preferred weight ratio is from 30:70 to 70:30 and an even more preferred weight ratio is from 40:60 to 60:40. A weight ratio of from 45:55 to 55:45 is especially preferred. Approximately equal quantities by weight are most preferably used in this step.

The melt spinning temperature is above the crystalline melting temperature of each of the starting PLA resins. Higher temperatures can be used if necessary, such as to reduce the viscosity of the melt, but a spinning temperature of greater than 240° C. is generally not preferred due to the potential for thermal degradation of the resins. A preferred temperature for the melt spinning step is 210° C. to 240° C. The spinning step may be done at or above the crystalline melting temperature of PLA stereocomplex crystallites, which can be as high as 230 to 235° C.

Spinning fibers in accordance with the invention, by separately melting the starting high-D and high-L resins, mixing the melts and then spinning the molten mixture without prior cooling to below the crystalline melting temperature of the starting resin, permits one to inexpensively and efficiently form fibers which, after heat treating, have very good heat resistance. The process of this invention permits one to minimize the length of time during which the mixture of starting PLA resins is exposed to temperatures above 170° C. At those temperatures, transesterification and molecular weight degradation occur most rapidly.

The high heat resistance of the fibers is believed to be related to the formation of high-melting stereocomplex crystallites. Although the invention is not limited to any theory, it is believed that the ability to form high temperature "stereocomplex" crystallites in the fiber diminishes as the thermal history of the PLA resin mixture becomes more severe, i.e. at higher temperatures and/or at longer exposure times to a given temperature above the crystalline melting temperatures of the starting PLA resins. With increasingly severe thermal history, the PLA resin mixture tends to lose the ability to form high-melting "stereocomplex" crystallites. In addition, the melting temperature of the high-melting crystallites that do form also tends to decrease from the expected value of about 230° C.

The reduced crystalline melting temperature is believed to be due to the presence of significant defects in the crystal structure. The crystal defects may arise as a result of transesterification reactions that occur between the high-L and high-D PLA resins. These transesterification reactions form block copolymers having poly-L and poly-D PLA segments. These block copolymers often have decreased ability to form stereocomplex crystallites, and often form stereocomplex crystallites that have crystalline defects that significantly reduce their melting temperatures.

This invention allows the severity of that thermal history to be minimized, mainly because the time that the PLA resin mixture is exposed to high temperatures can be kept small. It is believed that by minimizing the thermal history of the PLA resin mixture in this manner, the resin in the fibers retains more of its ability to form stereocomplex crystallites. The melting temperature of those crystallites also tends to be closer to the expected value, than when the thermal history is more severe. It is believed that these effects are due to fewer transesterification reactions occurring between the high-D and high-L polymers during the spinning process.

The melting, mixing and spinning steps therefore are suitably conducted in a manner such that the starting resins and resin mixture are exposed to temperatures above their crystalline melting temperatures for only short periods. Preferably, the time from combining the melted starting resins until the fibers are cooled is no greater than 10 minutes, more preferably no greater than 3 minutes and even more preferably no greater than 1 minute.

After spinning, the fibers are cooled to a temperature below the crystalline melting temperatures of the starting resins. This allows the PLA resins to solidify enough to perform subsequent processing steps.

The fibers are then subjected to a heat treatment step, which promotes the formation of high-melting crystallites in the fiber. This may be performed immediately after cooling the fibers below the crystalline melting temperature of the starting resins. In this case, the fiber obtained from the spinning operation is cooled directly to the heat-treatment temperature and held at that temperature to allow high-melting crystallites to from. Alternatively, the heat-treatment step can be performed at some later time, after one or more intermediate processing operations. In many cases, multiple heat treatment steps may be performed. For example, a heat treatment step can be performed during the initial cool-down of the freshly spun fibers, to develop some high-melting crystallinity. In such as case, one or more subsequent heat treatment steps can be performed at some later time, after one or more intermediate processing operations.

The heat treatment step or steps are performed at a temperature between that of the glass transition temperature of the starting resins and the crystalline melting temperature of the starting resins. A suitable temperature is from 90° C. to 160° C., and a more preferred temperature is from 100° C. to 150° C. The fibers may be maintained under tension during the heating step, to prevent or minimize shrinkage. The heat treatment step is often conveniently performed in conjunction with another ordinary fiber-processing operation, as explained further below.

The heat treatment step or steps are performed for a time that is long enough to form in the fiber at least 20 J of crystallites that have a crystalline melting temperature of at least 200° C. per gram of PLA resin. These crystallites are believed to be a crystalline form involving molecules of both the high-D resin and high-L resin, and are often described (and are referred to herein) as "stereocomplex" crystallites. The high-melting crystallites preferably have a crystalline melting temperature of at least 210° C., more preferably at least 210° C., even more preferably at least 215° C. and most preferably from about 220-235° C. The heat-treated fiber may contain 25 J or more, 30 J or more, 35 J or more, or even 40 J or more of crystallites having a melting temperature of at least 210° C., preferably at least 215° C., especially at least 220° C., per gram of PLA resin in the fiber. The time needed to perform the heat treatment step is typically no more than a few seconds, but heat treatment up to about 15 minutes may be used depending on the specific equipment used, heat treatment temperature, and desired extent of crystallization. The heat treatment step may also cause PLA resin crystallites to form. "PLA resin crystallites" are crystalline structures formed by the crystallization of the high-D or high-L polymer with itself. These crystallites have a characteristic crystalline melting temperature which is similar to that of the high-D and/or high-L starting resins by themselves, typically approximately 140 to 170° C. The formation of large amounts of the PLA resin crystallites is less preferred. Preferably, no more than 20 J of these crystallites are formed in the heat setting process per gram of PLA resin in the fiber. More preferably, no more than 15 J of these crystallites are formed, and even more preferably, no more than 10 J of these crystallites are formed, per gram of PLA resin in the fiber. In most preferred processes, from 0 to 5 J of the PLA resin crystallites are formed per gram of PLA resin in the fiber.

Crystallization melting temperatures and the amount of crystallinity in a fiber sample are determined for purposes of this invention by differential scanning calorimetry (DSC), using the methods described in U.S. Pat. No. 6,506,873.

Once the requisite amount of high-melting crystallites has been formed, the fibers are cooled to below the glass transition temperature of the PLA resins. This cooling will prevent further crystallites from forming.

The heat treatment step can be performed any time after the fiber is spun and cooled to below the crystalline melting temperature of the starting resins. Some fiber-manufacturing processes include stretching, calendaring, drying or other steps in which the fibers are exposed to the necessary temperature. The heat treatment step can be performed as part of those processes, or in a modification of those process steps if necessary to provide enough residence time at the heat treatment temperature to form the high-melting crystallites. An advantage of the process of this invention is that it is easily incorporated into common commercial-scale processes for making various types of fiber and textile products.

A typical commercial-scale melt-spinning process includes an extruder, which feeds molten resin into one or more spin packs. The spin packs contain one or more orifices through which the fibers are extruded. A manifold, metering pump or other intermediate device may be interposed between the extruder and the spin pack(s). The process of this invention can be practiced on the same equipment, the only necessary modification being to provide a means by which the two starting PLA resins are mixed prior to the actual fiber spinning step. A convenient way of doing this is to provide two extruders, each of which feeds the spin pack or an intermediate device such as a manifold or metering pump. One of the extruders will supply molten high-D resin to the process, and the other will supply molten high-L resin. The two extruders may feed directly into the spin pack, in which case the high-D and high-L PLA resins become mixed within the spin pack before the fibers are spun. A particulate solid such as metal shavings can be present within the spin pack to facilitate this mixing. Alternatively, the two extruders may feed an intermediate device, such as a manifold, metering pump, a high shear mechanical mixer, or static mixer, in which the high-D and high-L PLA resins are mixed before they are introduced to the spin pack.

In processes for forming long filament-type fibers such as bulk continuous filament (BCF) or partially oriented yarn (POY), the spin packs typically contain multiple orifices and produce multiple filaments which in most cases are formed into a bundle to form a fiber or yarn. In a typical process of this type, all or part of the filaments exiting a spin pack are bundled and hot stretched to provide some initial orientation. The temperature during this initial stretching is usually between the glass transition temperature and the crystalline melting temperature of the starting PLA resins. Therefore, some crystallinity may develop during this stage. However, commercial line speeds during this step are usually fast enough that little or no (e.g., 10 J/g or less) high melting crystallites form. The small amount of crystallinity that develops during this step may include lower-melting crystals of the high-D PLA resin or the high-L PLA resin by themselves. However, it is possible to adapt the process at this stage to provide additional time during the stretching step to permit high-melting crystallites to form.

POY is generally oriented and crystallized enough (although mainly with low-melting crystallites) that it can be packaged and shipped if needed to another destination for further processing and finishing. POY is often subjected to further processing steps to form products like flat yarns or textured yarns. POY is processed into flat yarns by heating the POY to above the resin glass transition temperature and further stretching it. The heat-treating step of this invention can be incorporated into this operation. POY is processed into textured yarns in a similar way, with the addition of one or more crimping or other steps to provide texture to the fibers. Again, the heat-treating step of this invention can be incorporated into the heating and further stretching of the POY to form a textured yarn.

Flat yarns, textured yarns and similar filament products are commonly woven or knitted to form fabrics for apparel and other applications. The heat-treatment step of this invention can be carried out on the fabrics, after the weaving or knitting step is completed. Many fabrics, especially those for apparel applications, are heat-set to reduce shrinkage. The heat-treatment step of this invention can be performed on the fabric simultaneously with such a heat-setting step.

Another common fiber product is staple fiber. Staple fiber generally has a length of from approximately 6 mm to 150 mm. In many commercial processes for producing staple fiber, filaments exiting the spin pack are formed into bundles and stretched while still hot, and then subjected to a secondary drawing or stretching process and heat treated under tension. The heat-treated bundles are typically roller heat set, optionally after crimping and drying, cut to length and baled. The baled staple fibers so produced are subsequently spun into yarns, which can be used in knitting or weaving fabrics. Alternatively, the staple fibers can be formed into fabrics by air laid, needle punching, spun-laid or other methods. The heat-treatment step of this invention can be incorporated into one or more of these manufacturing steps. For example, the heat treating step of this invention can be performed during hot stretching; during the step of heat treating under tension; during the roller heat set step; or by heat-treating the yarn after spinning or a fabric after knitting, weaving air laying, needle-punching or spun-laying. In addition, the staple fibers can undergo the heat treatment step of this invention during a drying step that is normally performed to drive water or solvents from the fibers. This drying step is often performed after the fibers are coated with a finish, such as a slickening finish, or after a dying step.

A third major fiber-forming process is a melt-blown or spunbond process. In these processes, the fibers are formed directly into a fabric. These processes are typically used to manufacture products such as wipes, drier sheets, high temperature filters, and the like. In these processes, fibers are formed from a spin pack as before, and stretched using a gas stream before being deposited onto a screen where the newly-formed fibers are formed into a fabric. Some orientation and high-melting crystallite formation can occur during the stretching step. Melt-blown and spunbond fabrics can be heat treated to form the high-melting crystallites after the fiber web is produced, during a calendaring step or in another downstream process.

Either or both of the starting PLA resins can contain various additives as may be useful in the particular fiber-forming process. A nucleating agent is often desirable, as the presence of the nucleating agent can increase the rate at which the stereocomplex crystallites nucleate and/or grow. This, in turn, can reduce the time required in the heat treatment step. Finely divided talc, titanium dioxide and other particulate materials may be used. Metallic salts of phosphoric acid esters, as described in U.S. Published Patent Application 2005/0001358, aromatic amides as described in JP 2005-042084A, aromatic ureas as described in WO 2005/63885A, and oxamide or isocyanuric acid derivatives as described in JP 2005-255806A are also useful nucleating agents.

Other additives include, for example, colorants, preservatives, biocides, antioxidants, and the like.

The heat treated fibers made in accordance with the invention are characterized in having high-melting crystallites that have crystalline melting temperature of at least 200° C., preferably at least 210° C., more preferably at least 215° C. and even more preferably from 220-235° C. The heat treated fibers preferably contain at least 20 J, more preferably at least 25 J, even more preferably at least 30 J, still more preferably at least 35 J and most preferably at least 40 J of crystallites that have a melting temperature of at least 210° C., especially at least 215° C., per gram of PLA resin in the fiber. The heat treated fibers preferably contain no more than 10 J, especially no more than 5 J, per gram of PLA resin in the fiber, of crystallites having a melting temperature of less than 200° C.

The process of the invention can be integrated into a PLA resin production facility. In such an integrated process, a molten stream of at least one of the starting PLA resins is fed from the production facility directly into the fiber-forming process. If the PLA resin production facility produces both the high-D and high-L starting resins, separate molten streams of the two starting resins can be fed from the production facility to the fiber-forming process. This integrated process has the benefit of eliminating steps of cooling, pelletizing and re-melting the starting PLA resin or resins that are fed directly from the production facility. This results in a savings in both energy and equipment costs.

EXAMPLE

A high-L PLA resin (containing about 98.6% L-lactide units and 1.4% D-lactic units) and a high-D PLA resin (containing 98-99% D-lactide units and 1-2% L-lactic units) are melted in separate extruders. The melt temperature for the high-L PLA resin is 225-235° C. and that for the high-D PLA resin is 230-240° C. The high-D PLA resin has a number average molecular weight of about 66,000; that of the high-L PLA resin is about 90,000. The extruders feed separate melt pumps, which in turn feed separate resin streams into a spin pack. The spin pack has internal modifications which allow the high-L and high-D PLA resins to mix inside of the spin pack. Fibers extruded through the spin pack contain about 50% by weight of each of the starting PLA resins. Residence time in the spin pack is well less than one minute.

The fibers leaving the spin pack pass through a quench chamber, where they are cooled with a stream of 17° C. air. The fibers are then collected and samples are analyzed by DSC to determine the type and amount of crystallites that they contain. No drawing or heat treatment is performed prior to DSC analysis. The average denier of the fibers is 125.

The DSC analysis shows that the fibers contain about 7.5 J/g of "stereocomplex" crystallites that have a peak melting temperature of 211° C. This indicates that part of the heat treatment step in this case is performed during the initial cool-down of the fibers immediately after they are spun. The samples also contain some lower-melting crystallites associated with the crystallization of L-PLA or D-PLA by themselves.

The presence of stereocomplex crystallites in fibers made under these conditions demonstrates that stereocomplexes can not only form, but can form quickly by bringing together separate melts of a high-L and a high-D PLA resin. In fiber manufacturing, the presence of stereocomplex crystallites in the fiber, even before drawing or any heat treatment is performed, can significantly improve the processing of the fiber. The formation of the stereocomplex crystallites increase the temperature that can be used to heat-set the fibers, which in turn can lead to an increase in the draw ratio, which in turn can lead to an increase in the tensile strength of the fiber.

Another sample of the fibers is treated by heating it in an oven, without applied tension, to a temperature of 140° C. for one hour. DSC of these heat-treated samples shows them to contain about 26 J/g of crystallites having a peak melting temperature of about 213° C.

What is claimed is:

1. A process for making a fiber of a polylactic acid, comprising a) forming separate melts of a high-D PLA starting resin and a high-L PLA starting resin;

b) mixing the melts and, without cooling the resulting mixed melt below the crystallization temperature of either the high-D PLA starting resin or the high-L starting resin, melt spinning the mixture through one or more orifices to form one or more fibers, then c) cooling the fibers below the crystalline melting temperature of the high-D PLA starting resin and the crystalline melting temperature of the high-L starting resin and d) heat treating the fibers at a temperature between the glass transition temperature of the starting PLA resins and the crystallization melting temperature of the starting PLA resins for a period of time such that the fibers form at least 20 Joules/g of crystallites having a crystalline melting temperature of at least 200° C.

2. The process of claim 1, wherein the heat treating step d) is conducted at a temperature from 90 to 160° C.

3. The process of claim 2, wherein the heat treating step d) is conducted at a temperature of from 100 to 150 C.

4. The process of claim 3 wherein at least 90% of the polymerized lactic acid units in the high-D PLA starting resin are D-lactic acid units, and at least 90% of the polymerized lactic acid units in the high-L PLA starting resin are L-lactic acid units.

5. The process of claim 4, wherein each of the high-D and high-L PLA starting resins has a number average molecular weight of from 20,000 to 150,000.

6. The process of claim 5, wherein in step b), the melted high-D and high-L PLA starting resins are mixed at a weight ratio of from 25:75 to 75:25.

7. The process of claim 6, wherein in step b), the melted high-D and high-L PLA starting resins are mixed at a weight ratio of from 40:60 to 60:40.

8. The process of claim 6, wherein step d) is conducted such that the fibers contain at least 20 J of crystallites having a melting temperature of at least 210° C., per gram of PLA resin in the fibers.

9. The process of claim 8, wherein in step d) is conducted such that the fibers contain at least 30 J of crystallites having a melting temperature of at least 210° C. per gram of PLA resin in the fibers.

10. The process of claim 6, wherein step d) is conducted such that the fibers contain no more than 10 J of crystallites having a melting temperature of from 150 to 180° C. per gram of PLA resin in the fiber.

11. The process of claim 10, wherein step d) is conducted such that the fibers contain from 0 to 5 J of crystallites having a melting temperature of from 150 to 180° C. per gram of PLA resin in the fiber.

12. The process of claim 6, wherein at least one of the high-D PLA resin and the high-L PLA resin contains a nucleating agent.

13. The process of claim 6, which is a process for producing a flat yarn or a textured yarn.

14. The process of claim 6, which is a process for producing a staple fiber.

15. The process of claim 6, which is a process for producing a spunbond or nonwoven fabric.

16. The process of claim 6, wherein step b) is conducted by feeding a molten high-D PLA resin and a molten high-L PLA resin from separate extruders into a spin pack, and mixing the molten high-D PLA resin with the molten high-L PLA resin in the spin pack and spinning the mixture through multiple orifices in the spin pack to form multiple filaments.

17. The process of claim 16, wherein the multiple filaments are formed into one or more bundles and stretched to form a partially oriented yarn.

18. The process of claim 17, wherein the partially oriented yarn is heated to a temperature above the resin glass transition temperature of the starting PLA resins and stretched to form a flat yarn or a textured yarn.

19. The process of claim 18, wherein step (d) is at least partially performed as the partially oriented yarn is converted to a flat yarn or textured yarn.

20. The process of claim 18, wherein the flat yarn or textured yarn is knitted or woven into a fabric, and step (d) is at least partially performed by heating the fabric at a temperature between the glass transition temperature of the starting PLA resins and the crystallization melting temperature of the starting PLA resins.

21. The process of claim 16 wherein the multiple filaments are formed into bundles, stretched while still hot, roller heat set and cut to form staple fibers.

22. The process of claim 21, wherein step (d) is at least partially performed while the bundles are roller heat set.

23. The process of claim 21, wherein the staple fibers are spun into a yarn and knitted or woven into a fabric, and step (d) is at least partially performed by heating the fabric at a temperature between the glass transition temperature of the starting PLA resins and the crystallization melting temperature of the starting PLA resins.

24. The process of claim 21, wherein the staple fibers are air laid, needle punched or spun-laid to for a fabric, and step (d) is at least partially performed by heating the fabric at a temperature between the glass transition temperature of the starting PLA resins and the crystallization melting temperature of the starting PLA resins.

25. The process of claim 16, wherein the multiple filaments are melt-blown or spunbond and formed directly into a fabric, and step (d) is at least partially performed by heating the fabric at a temperature between the glass transition temperature of the starting PLA resins and the crystallization melting temperature of the starting PLA resins.

* * * * *